United States Patent [19]

Kuna

[11] 4,146,227

[45] Mar. 27, 1979

[54] PROJECTILE GAME WITH PLURAL CENTRAL TARGET AREAS

[75] Inventor: Wayne A. Kuna, Elmhurst, Ill.

[73] Assignee: Marvin Glass & Associates, Chicago, Ill.

[21] Appl. No.: 825,193

[22] Filed: Aug. 17, 1977

[51] Int. Cl.[2] ..... A63B 63/04; A63F 7/04

[52] U.S. Cl. ..... 273/119 R; 273/123 R; 273/127 D

[58] Field of Search ..... 273/123 R, 119 R, 127 D, 273/85 C, 85 D, 129 HA, 127 R

[56] References Cited

U.S. PATENT DOCUMENTS

| | | | |
|---|---|---|---|
| 1,163,102 | 12/1915 | Morgan | 273/119 R |
| 1,942,476 | 1/1934 | Harris | 273/119 R |
| 2,632,649 | 3/1953 | Schaefer | 273/125 R |
| 3,119,620 | 1/1964 | Peterson | 273/129 HA |
| 3,429,574 | 2/1969 | Williams | 273/127 R |
| 3,643,946 | 2/1972 | Ylinen | 273/85 R |
| 3,897,952 | 8/1975 | Breslow | 273/127 D |
| 4,046,380 | 9/1977 | Goldfarb et al. | 273/119 R |

FOREIGN PATENT DOCUMENTS

| | | | |
|---|---|---|---|
| 680997 | 1/1930 | France | 273/119 R |
| 746550 | 3/1933 | France | 273/85 D |
| 6400594 | 1/1964 | Netherlands | 273/85 C |
| 416790 | 9/1934 | United Kingdom | 273/119 R |

*Primary Examiner*—Richard J. Johnson
*Assistant Examiner*—Lawrence E. Anderson
*Attorney, Agent, or Firm*—Mason, Kolehmainen, Rathburn & Wyss

[57] ABSTRACT

A skill type game which includes two opposed playing areas, a centrally located target arrangement and a projector device provided in each of the playing areas. The projector devices are slidable from side to side and rotatable for selective alignment with a plurality of projectiles or balls which are arranged in a corresponding plurality of projectile receiver slots. The projector device includes a slidable, rotatable shaft manipulated by a handle portion. The projector device further includes a human figure-shaped kicker member carried by the shaft with a foot portion of the kicker member contacting the projectiles. The target arrangement includes a purality of projectile target areas or goals each of which is adapted to retain a properly launched projectile from either playing area. The projectile target areas also provide for dislodgement of a retained projectile upon a predetermined contact from another projectile from either playing area. A pivotal game lockout device is also provided to allow either of the game players to prevent dislodgement of the projectiles in the target areas when all the projectile target areas have been filled.

2 Claims, 5 Drawing Figures

PROJECTILE GAME WITH PLURAL CENTRAL TARGET AREAS

BACKGROUND OF THE INVENTION

The invention relates to skill type games designed for the entertainment of the players and for developing dexterity, timing and coordination for the individual players, as well as competition between the players.

There are various entertaining games presently available which have projectiles of various sizes and shapes which are projected toward target areas. A plurality of receiving positions are provided for the projectiles normally providing means for scoring a game. Still other games have projectiles which are propelled toward receiving positions randomly spaced and variably scored to provide an entertaining game.

Another type of game described in U.S. Pat. No. 3,897,952 which issued to J. D. Breslow on Aug. 5, 1975, includes movable hammer-shaped targets. The hammer-shaped targets are pivotally mounted and movable between opposed playing areas in response to being struck by a projectile launched from the particular playing area in which the hammer is disposed. A locking device to block movement of the target hammers when either player has moved all the targets from his playing area to the opponents playing area is provided.

Another projectile launching game described in U.S. Pat. No. 1,942,476 which issued to W. W. Harris on Jan. 9, 1934, includes a number of centrally disposed target members between opposed playing areas. Projectiles which are properly aimed and projected with the proper force are retained in the target member by yieldable elements arranged around the periphery of an opening in the target member. The opposing game player may dislodge the retained projectile upon proper contact.

A principal object of the present invention is to provide a new skill type game of the character described.

More specifically, the invention includes a plurality of launchable projectiles, a game board having two opposing playing areas adjoined by a centrally disposed target arrangement including a plurality of projectile target areas which are arranged to retain a properly launched and aimed projectile. Each of the playing areas is provided with a launching station including a projector device which is slidably and rotatably mounted for selective alignment with a plurality of projectiles arranged within a corresponding plurality of projectile receiver slots. The projector device includes a human figure-shaped kicker member arranged on the rotatable and slidable projector device wherein a foot portion of the kicker member contacts the projectile. The projectile target areas are adapted for the dislodgement of a retained projectile upon a predetermined contact by another launched projectile. A game lockout arrangement is provided and is operable by either of the game players for preventing the further dislodgement of projectiles retained within the target areas.

Other objects, features and advantages of the present invention will become apparent from the following detailed description taken in conjunction with the accompanying drawings.

DESCRIPTION OF THE PREFERRED EMBODIMENT

Figure 1:
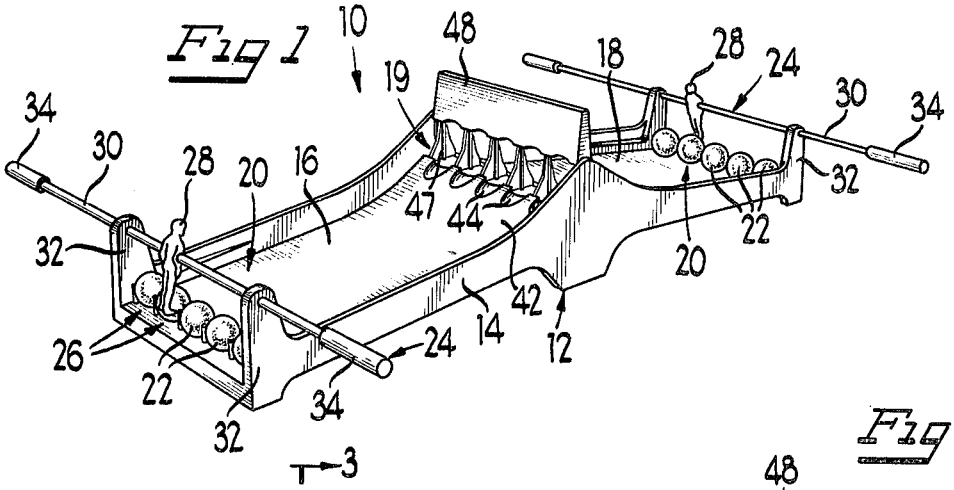
FIG. 1 is a perspective view of a skill type game embodying the concepts of the present invention.

Referring to FIG. 1, the game of the present invention generally designated 10 includes a generally elongated housing 12 having upstanding support walls 14 on either side of the elongated housing. Two playing areas 16 and 18 are formed on the top of the housing 12 and separated by a centrally disposed target arrangement 19. The playing areas 16 and 18 slant downwardly away from the center target arrangement 19 and are bounded on their sides by the inside surfaces of the upstanding support sidewalls 14. At each end of the playing areas 16 and 18 remote from the center of the housing 12, a launching station or area 20 is provided from which a plurality of projectiles 22 are launched or projected.

Each of the launching stations 20 is provided with a projector device generally designated at 24. The projector devices 24 are slidably mounted for side-to-side movement and pivotally mounted for rotation within the housing 12 to provide selective alignment with a plurality of projectiles 22 which are disposed within a corresponding plurality of projectile receiver slots 26.

Each of the projector devices 24 includes a human figure-shaped projector or kicker member 28 fixedly carried on an elongated shaft 30 which is slidably and rotatably mounted within upstanding end portions 32 of the sidewalls 14. Each of the elongated shafts 30 includes an enlarged handle portion 34 at one or both ends of each of the rods for manipulation by each of the game players.

The projector or kicker member 28 includes a foot portion 36 which is disposed to contact the projectiles 22 as the shaft 30 is rotated. The game players selectively align the projector member 28 with a desired one of the plurality of projectiles 22 in the launching station 20 by sliding the shaft 30 from side to side across the launching station area 20. The shaft 30 is then rotated with a desired speed and force to contact one of the projectiles 22 and project or launch the projectile up one of the corresponding inclined playing areas 16 or 18 toward the target arrangement 19. The projectiles 22 are retained within the defined projectile receiver slots 26 at each of the launching stations 20 by upstanding, spaced posts or pegs 38.

The target arrangement 19 is defined centrally of the playing area 16, 18 and includes a plurality of projectile target areas 40 corresponding in number to the number of projectiles 22 and projectile receiver slots 26 at each launching station 20. On either side of the target arrangement 19 the inclined surfaces of the playing areas 16 and 18 include a sharply upward curving portion 42 and a number of target approach ramps 44 formed in the curved surface 42 and having a generally paraboloid shape. A target approach ramp 44 is disposed adjacent each of the target areas 40 and adjoining a recessed horizontal retention surface or area 46 which is dimensioned to allow movement of a retained projectile 22. The curved portion 42, target approach ramp 44 and the recessed retention surface 46 define the projectile target areas 40 of the target arrangement 19.

In accordance with important aspects of the present invention, a projectile 22 properly launched from the projector device 24 of either launching station 20 rolls up one of the inclined playing areas 16, 18 and into one of the projectile target areas 40. The projectile then remains within the recessed retention area 46 unless contacted by another projectile 22 projected by either projector device 24 whereupon the first retained projectile 22 is dislodged and rolls down one of the playing areas 16 or 18 opposite the playing area from which the second projectile originated. The plurality of projectile target areas 40 are separated and defined by upstanding, generally triangular support members 47.

In accordance with other important aspects of the present invention, a game lockout device 48 is provided in the vicinity of the target arrangement 19 and is a pivotally mounted, generally planar member. The game lockout member 48 includes a bifurcated downwardly extending portion 50 at either end defining two finger portions 52, 54 having respective enlarged portions 56, 58 at the end of the downward projection forming a narrowed bifurcated section 59. The bifurcated downwardly extending portions 50 are each disposed about a projecting pin 60 extending from a raised sidewall portion 62 of each of the sidewalls 14 with the game lockout member 48 being movable and rotatable about the pins 60.

Figure 2:
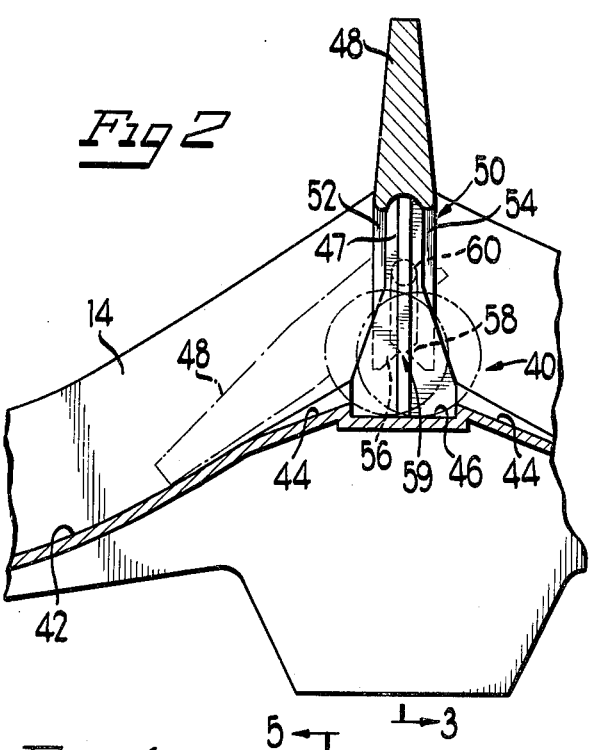
FIG. 2 is an enlarged, fragmentary generally vertical sectional view illustrating the target arrangement and the game lockout device of the skill type game of FIG. 1.
Figure 3:
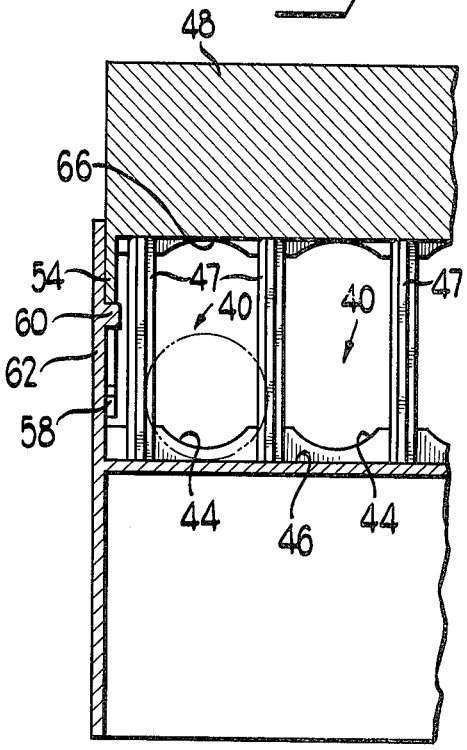
FIG. 3 is a fragmentary sectional view taken generally along the line 3—3 of FIG. 2.
Figure 4:
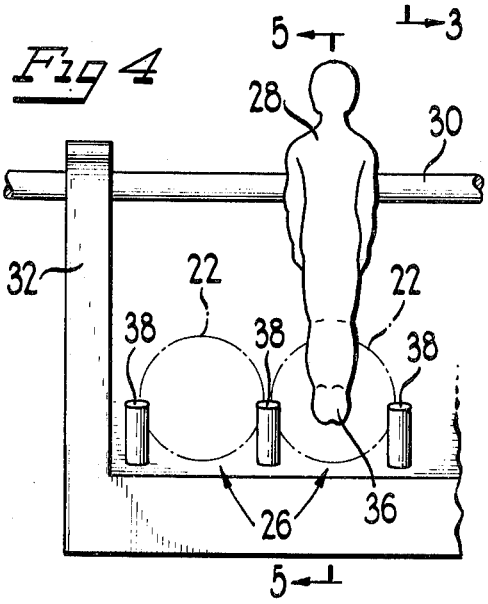
FIG. 4 is a fragmentary, enlarged elevational view of the projector device and the launching station of the skill type game of FIG. 1.
Figure 5:
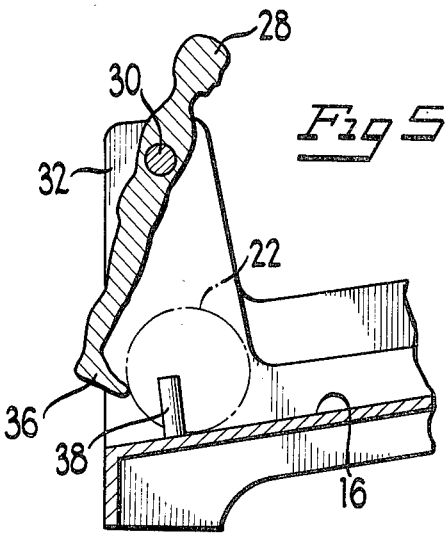
FIG. 5 is a fragmentary view partly in section taken generally along the line 5—5 of FIG. 4.

In the normal course of the play of the game, the game lockout member 48 is in the upward generally vertical position, FIGS. 2 and 3, supported atop the spaced members 47 arranged between adjacent projectile target areas 40 and at both ends of the target arrangement 19. In the game lockout position shown in phantom in FIG. 2, the game lockout member 48 is raised until the pivot pin 60 contacts the extending portions 56, 58 and is then pivoted to either side and lowered into contact with the curved portion 42. The game lockout member is provided with generally semicircular cutout portions defining arcs 66 disposed adjacent and aligned with each of the projectile target areas 40. The arcs 66 contact corresponding ones of the plurality of retained projectiles 22 thus restricting further dislodgement or movement of the retained projectiles 22.

In one scheme of play, each of the launching stations 20 is provided with a plurality of projectiles 22, five for example, of a different color for each game player for identification purposes. It should be understood, however, that other identification schemes are also contemplated. The game players then proceed by the manipulation of the projector devices 24 to align and project the projectiles 22 toward the target arrangement 19 in the proper direction and with the proper force to cause the projectiles 22 to be retained within the plurality of corresponding projectile target areas 40.

Play continues until one game player has succeeded in placing all five of his projectiles within the target areas 40 whereupon the game player manipulates the game lockout member 48 to the end of game position. During the course of the play, opposing players may dislodge their opponents projectiles from the projectile target areas 40 and replace the dislodged projectile with their own. If the game players do not aim carefully, they may also dislodge their own projectile 22.

In another scheme of play, the game ends whenever all of the projectile target areas 40 are filled and the player with the greater number of projectiles 22 in the target areas 40 is considered or declared the winner.

To further vary the scheme of play and increase the interest of the game players, the game players may both shoot for the same predetermined projectile target area 40 until one of the players succeeds in filling or scoring this target area 40. Next, the players go on to the next target area 40 in a predetermined sequence; for example left to right or right to left. To vary this scheme of play, the game players may either air for the next empty target area 40 or attempt to dislodge the previously filled target area if occupied by the projectile of an opponent.

The foregoing detailed description has been given for clearance of understanding only and no unnecessary limitation should be understood therefrom as some modifications will be obvious to those skilled in the art.

I claim:

1. A skill type game comprising:

a plurality of launchable projectiles;

a frame defining a game board having two opposing adjoining inclined playing areas and a launching station in each playing area;

target means centrally disposed between said adjoining playing areas for retaining a plurality of properly launched projectiles within a corresponding plurality of projectile target areas, said target means adapted for dislodgement of a retained projectile within a target area upon predetermined contact by another launched projectile with said retained projectile, said target means comprising a target retention surface for each of said plurality of projectile target areas recessed below said adjoining surfaces of said playing areas and upstanding separating members disposed between adjacent target retention surfaces, the target retention surfaces and the upstanding separating members defining the projectile target area, the adjoining surfaces of said playing areas and said projectile target areas being sharply upwardly curving with respect to said general inclined playing area surface and including a paraboloid shaped approach ramp aligned with each of said projectile target areas defined by a recessed portion of said adjoining surfaces; and means associated with each launching station for selectively projecting a plurality of projectiles arranged in a corresponding plurality of projectile receiver positions, each of said projecting means being movable in a predetermined manner across said corresponding playing area to be aligned with a particular one of said projectile receiver positions.

2. A skill type game, comprising:

a plurality of launchable projectiles;

a frame defining a game board having two opposing adjoining inclined playing areas and a launching station in each playing area;

target means centrally disposed between said adjoining playing areas for retaining a plurality of properly launched projectiles within a corresponding plurality of projectile target areas, said target means adapted for dislodgement of a retained projectile within a target area upon predetermined contact by another launched projectile with said retained projectile;

means associated with each launching station for selectively projecting a projectile toward said target means;

lockout means arranged adjacent said target means for preventing dislodgement of said retained projectiles in a first predetermined position and allowing dislodgement of said retained projectiles in a second predetermined position, said lockout means being movable between first and second predetermined positions by a lifting movement and a pivotal movement, said lockout means contacting said retained projectiles in said first predetermined position; and a projecting pivot pin located on either side of said target means and said lockout means comprising a generally planar lockout member and two downwardly extending bifurcated portions at each end of said lockout member, said bifurcated portions being disposed about said pivot pins, said frame including upstanding members at each end of said target means and said lockout member being supported in said second position by contact with said upstanding frame members.

* * * * *